United States Patent [19]

Chato

[11] Patent Number: 4,846,149

[45] Date of Patent: Jul. 11, 1989

[54] FLUID HEATER USING PULSATING COMBUSTION

[76] Inventor: John D. Chato, 1412-1450 Chestnut St., Vancouver, B. C. V6J-3K3, Canada

[21] Appl. No.: 148,880

[22] Filed: Jan. 27, 1988

[51] Int. Cl.[4] ..... F24H 1/20; F22B 31/00; F23C 11/04

[52] U.S. Cl. ..... 126/360 R; 126/350 R; 431/1; 122/24

[58] Field of Search ..... 126/360 R, 350 R, 99 R, 126/116 R; 122/17, 48, 114, 155 R, 24; 431/1

[56] References Cited

U.S. PATENT DOCUMENTS

| | | | |
|---|---|---|---|
| 2,748,753 | 6/1956 | Sarrazin et al. | 122/24 |
| 3,119,436 | 1/1964 | Rydberg | 431/1 |
| 3,606,867 | 9/1971 | Briffa | 431/1 X |
| 3,738,290 | 6/1973 | Belter | 431/1 X |
| 4,314,444 | 2/1982 | Putnam et al. | 122/24 X |
| 4,318,392 | 3/1982 | Schreiber et al. | 431/328 X |
| 4,369,208 | 1/1987 | Inui et al. | 431/1 |
| 4,708,634 | 11/1987 | Vergne | 431/1 |
| 4,750,452 | 6/1988 | Trihey | 431/1 X |

*Primary Examiner*—Randall L. Green
*Attorney, Agent, or Firm*—Sim & McBurney

[57] ABSTRACT

A fluid container includes at least one pulsating combustion unit which defines an elongate exhaust passageway between two substantially parallel plates, along with an elongate combustion chamber communicating with the exhaust passageways. Two end caps close the ends of the elongate passageway and the elongate chamber. Inlets are provided for admitting a combustible fuel mixture to the combustion chamber, and spark plugs provide ignition means to ignite the mixture. The unit is disposed in the container in such a way that a major part of each of the plates defining the exhaust passageway is in direct contact with the fluid. By initiating and sustaining pulsating combustion in the combustion chamber, a high-amplitude shockwave passes through the exhaust gases, which effectively "scrubs" away the gaseous, laminar surface film on the plates, thus enhancing heat transfer through the plates.

9 Claims, 2 Drawing Sheets

FLUID HEATER USING PULSATING COMBUSTION

This invention relates generally to the principle of pulsating combustion, and has to do particularly with a method by which pulsating combustion can be utilized to increase the efficiency of heating of a fluid such as water, and an apparatus for carrying out the method.

BACKGROUND OF THIS INVENTION

U.S. Pat. No. 4,454,436, dated June 12, 1984, entitled "Disk-Shaped MHD Generator", invented by myself and Anthony J. Last, discloses an apparatus in which pulsating combustion is utilized to provide a magnetohydrodynamic generator.

I have now recognized that pulsating combustion can be utilized for enhancing a process which is quite distinct from that of generating electricity in a magnetohydrodynamic generator. My new process is one which takes advantage of the agitation of the exhaust gases in a pulsating combustor, and which utilizes that agitation to "scrub" away the stagnant surface film of gaseous material on the "hot" side of a heat exchanger partition intended to transmit heat into a fluid like water.

GENERAL DESCRIPTION OF THIS INVENTION

Accordingly, this invention provides, in combination:

means defining a container for a fluid, and at least one pulsating combustion unit, said at least one unit having:

(a) an elongate exhaust passageway defined between two substantially parallel plates made of a material and having a thickness which allows a rapid transfer of heat energy from one plate surface to the other, (b) an elongate combustion chamber communicating with said exhaust passageway, (c) end cap means closing the ends of the elongate passageway and the elongate chamber, (d) inlet means for admitting a combustible fuel mixture to the combustion chamber, and (e) ignition means for igniting the fuel mixture, said at least one unit being disposed in the container such that a major portion of each of the plates is in direct con-tact with the fluid, the combination further including collection means for removing exhaust gases from said exhaust passageway.

Further, this invention provides a method of heating a fluid in a container, comprising the steps:

(a) providing at least one pulsating combustor having:

an elongate exhaust passageway defined between two substantially parallel plates made of a material and having a thickness which allows a rapid transfer of heat energy from one plate surface to the other, an elongate combustion chamber communicating with said exhaust passageway, end cap means closing the ends of the elongate passageway and the elongate chamber, inlet means for admitting a combustible fuel mixture to the combustion chamber, and ignition means for igniting the fuel mixture, (b) placing the unit within the container such that a major portion of each plate is in contact with the fluid, and (c) admitting a combustible fuel mixture to the combustion chamber and igniting the mixture to initiate pulsating combustion, whereby agitation of the hot exhaust gases in the exhaust passageway due to the pulsating combustion enhances heat transfer to and through the plates, and thence into the fluid.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
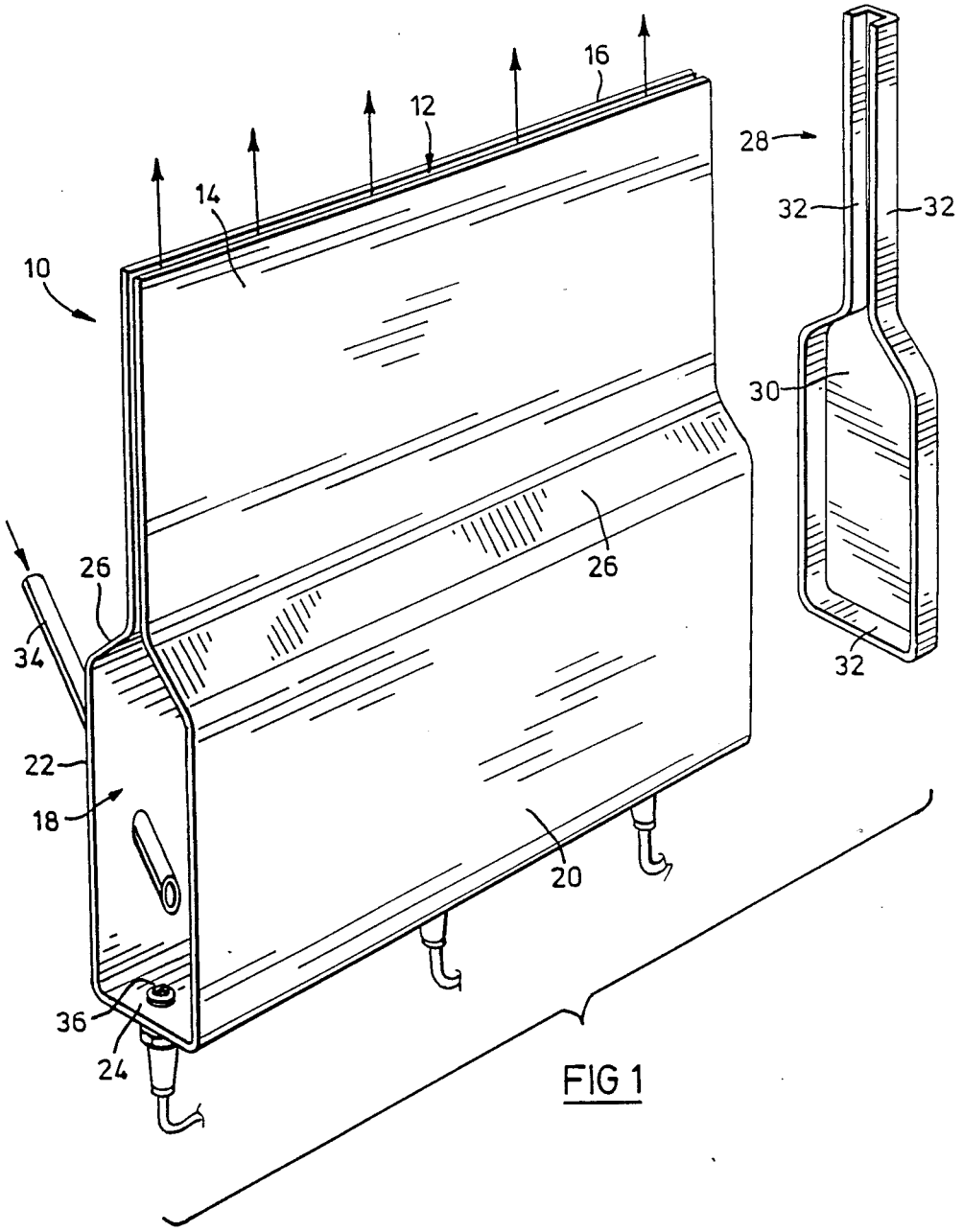
FIG. 1 is a perspective view of a pulsating combustion unit for use with this invention.

Attention is first directed to FIG. 1, which shows a pulsating combustion unit 10, which has an elongate exhaust passageway 12 defined between two substantially parallel plates 14 and 16 made of a material and having a thickness which allows a rapid transfer of heat energy from one plate surface to the other. The plates are preferably made of metal with a relatively high heat transfer characteristic. The unit 10 further incorporates an elongate combustion chamber 18 which communicates with the exhaust passageway 12. As can be seen in FIG. 1, the combustion chamber 18 and the exhaust passageway 12 are in vertical alignment and, seen in section, they are symmetrically arranged about a common vertical axis. The combustion chamber 18 is defined between two parallel side walls 20 and 22 spaced apart by a greater distance than separates the plates 14 and 16. The chamber 18 also has a bottom wall 24, and transition shoulders 26 which extend between each plate 14, 16 and the corresponding side wall 20, 22 of the combustion chamber 18.

The unit 10 further incorporates two end caps 28, one at either end of the unit 10. In FIG. 1, only one cap 28 has been illustrated, in exploded relation with respect to the remainder of the unit. The end cap 28 has a main wall 30 corresponding to the vertical section through the main portion of the unit 10, and flanges 32 intended for welding or otherwise securing to the marginal end portions of the main part of the unit 10.

The unit 10 incorporates a plurality of fuel inlets 34 for admitting a combustible fuel mixture to the combustion chamber 18, and further has ignition means in the form of a plurality of spark plugs 36 spaced along the bottom wall 24 at approximately the central region thereof.

Figure 2:
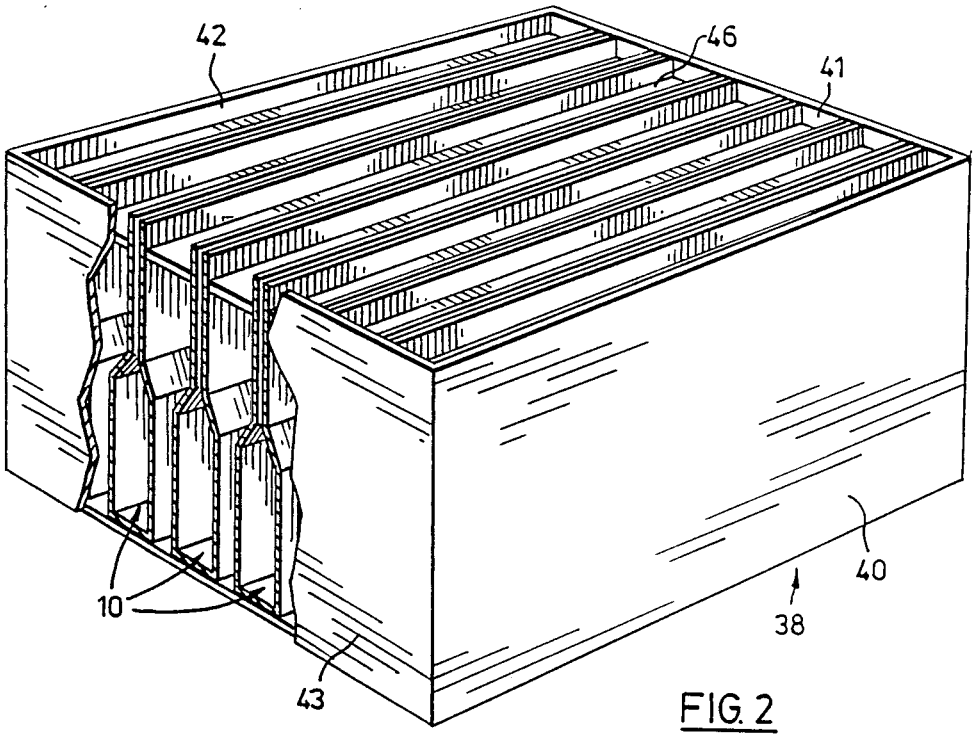
FIG. 2 is a partly broken-away perspective view of a liquid heater utilizing a plurality of the units shown in FIG. 1.

As can be seen in FIG. 2, the unit 10 described with respect to FIG. 1 is adapted to be immersed, along with other identical or similar units, in a liquid container 38 which has a bottom (not visible in FIG. 2) and four sides 40–43 forming a box-like structure which is open at the top in the figure. As can be seen, the units 10 are immersed in the liquid except for the uppermost marginal portion of the exhaust passageway, which projects above the top surface 46 of the liquid. This permits a major portion of each of the plates 14, 16 defining the exhaust passageway 12 to be in direct contact with the liquid in the container. Suitable means (not shown) are provided for maintaining the geometrical relationship of the different units 10 to each other and to the container 38.

Figure 3:
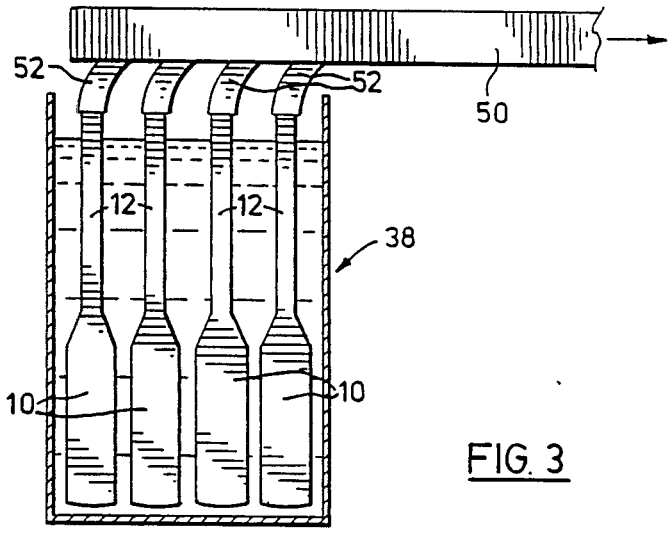
FIG. 3 is a vertical sectional view through a variant of the heater shown in FIG. 2.

The completed installation further includes a collection means for removing exhaust gases from the exhaust passageways 12 of the various units 10, and in FIG. 3 the collection means is shown as an exhaust plenum 50 communicating with all of the exhaust passageways 12 through ducts 52.

In operation, the various units 10 are installed as illustrated in FIGS. 2 and 3 within a container 38 holding a liquid such as water, in such a way that a major portion of each of the plates 14, 16 is in contact with the liquid. A combustible fuel mixture is then admitted to the combustion chambers through the fuel inlets 34, and is ignited by the spark plugs 36 to initiate pulsating combustion within each of the units 10. The sequence of events in pulsating combustion is well known. After each rapid combustion of gases, the products of combustion are immediately exhausted. This produces a steep pressure rise, followed by an immediate drop in pressure. Due to the inertia of the gases and the cooling of the gases through heat exchange at the walls, an overall negative pressure is produced and as a result a quantity of the surrounding atmosphere, plus fuel, plus a small portion of the exhaust gases still in the exhaust passageway 12, is sucked into the combustion chamber 18. As the temperature in the chamber is still high, the new intake also burns rapidly and the process is repeated.

The result of pulsating combustion in a unit of the kind shown in FIG. 1 is to superimpose, on the exhaust gases exiting through the exhaust passageway 12, a repeating, high-amplitude high pressure wave which acts to enhance significantly the transfer of heat from the exhaust gases into and through the plates 14 and 16 defining the exhaust passageway 12. In effect, the surface lamina of gas normally found on the gaseous side of a gas/liquid heat exchange partition is "scrubbed" away by the intense agitation of the molecules of exhaust gas within the exhaust passageway 12. Since such laminar stratification normally reduces the heat-transfer efficiency of a heat exchange partition, its absence can only increase that efficiency.

By making the entire unit 10 of a relatively thin material with a high heat transfer characteristic (such as a thin metal), heat can be transferred from the unit 10 into the surrounding liquid at all locations of contact, thus further increasing the percentage of the produced heat which is transferred into the liquid.

While not wishing to be bound by dimensions, it is desirable to give a general idea of suitable dimensions. For example, if the overall vertical height of the unit were about 12 inches, which included a combustor height of 3½ inches, the combustor having a lateral or transverse width of about 1 inch, then the distance between the plates 12 and 14 would typically lie between 130 and 170 thousandths of an inch.

It should be noted this invention is also adapted to the heating of gaseous materials, in which case the container would have to be fully closed. Gaseous materials would not require the units to have any particular orientation. Even for liquids, the units could exhaust downwardly through the bottom of the container 38.

While one embodiment of this invention has been illustrated in the accompanying drawings and described hereinabove, it will be evident to those skilled in the art that changes and modifications may be made therein, without departing from the essence of this invention as set forth in the appended claims.

The embodiments of the invention in which an exclusive property or privilege is claimed are defined as follows:

1. In combination:

means defining a container for a fluid, and at least one pulsating combustion unit, said at least one unit having:

(a) an elongate exhaust passageway defined between two substantially parallel plates made of a material and having a thickness which allows a rapid transfer of heat energy from one plate surface to the other, (b) an elongate combustion chamber communicating with said exhaust passageway, (c) end cap means closing the ends of the elongate passageway and the elongate chamber, (d) inlet means for admitting a combustible fuel mixture to the combustion chamber, and (e) ignition means for igniting the fuel mixture, said at least one unit being disposed in the container such that a major portion of each of the plates is in direct contact with the fluid, the combination further including collection means for removing exhaust gases from said exhaust passageway.

2. The invention claimed in claim 1, wherein there are a plurality of said pulsating combustion units disposed in adjacent, spaced apart, substantially parallel relation within the said container, the said collection means being adapted to duct exhaust gases from all exhaust passageways.

3. The invention claimed in claim 2, in which each unit exhibits a substantially constant cross section, the units being disposed such that the elongation of the combustion chambers is substantially horizontal with each exhaust passageway disposed above the respective combustion chamber, the said plates being disposed in vertical planes, the fluid being a liquid.

4. The invention claimed in claim 2, in which said collection means is an exhaust plenum communicating with all of the exhaust passageways.

5. The invention claimed in claim 2, in which each combustion chamber is defined by two parallel side walls spaced apart by a greater distance than separates the said plates, a bottom wall, and transition shoulders extending between each plate and the corresponding side wall of the combustion camber.

6. The invention claimed in claim 3, in which said collection means is an exhaust plenum communicating with all of the exhaust passageways.

7. The invention claimed in claim 6, in which each combustion chamber is defined by two parallel side walls spaced apart by a greater distance than separates the said plates, a bottom wall, and transition shoulders extending between each plate and the corresponding side wall of the combustion chamber.

8. A method of heating a fluid in a container, comprising the steps:

(a) providing at least one pulsating combustor having:

an elongate exhaust passageway defined between two substantially parallel plates made of a material and having a thickness which allows a rapid transfer of heat energy from one plate surface to the other, an elongate combustion chamber communicating with said exhaust passageways, end cap means closing the ends of the elongate passageway and the elongate chamber, inlet means for admitting a combustible fuel mixture to the combustion chamber, and ignition means for igniting the fuel mixture, (b) placing the unit within the container such that a major portion of each plate is in contact with the fluid, and (c) admitting a combustible fuel mixture to the combustion chamber and igniting the mixture to initiate pulsating combustion, whereby agitation of the hot exhaust gases in the exhaust passageway due to the pulsating combustion enhances heat transfer to and through the plates, and thence into the fluid.

9. The invention claimed in claim 8, in which there are provided a plurality of such pulsating combustors, each being rectilinearly elongated with a substantially constant cross section, and in which the step of placing is carried out by disposing the units in parallel, spaced apart relation within the container, with the combustion chamber being at the bottom with its rectilinear elongation being substantially horizontal, and the exhaust passageways being at the top, the plates being in substantially vertical planes, the method further comprising ducting exhaust gases away from the exhaust passageways.

* * * * *